US006938296B1

(12) United States Patent
Scheuermann

(10) Patent No.: US 6,938,296 B1
(45) Date of Patent: Sep. 6, 2005

(54) PORTABLE GOLF CLUB WASHER

(76) Inventor: Paul E. Scheuermann, 79 Country Pl., Springfield, IL (US) 62703

( * ) Notice: Subject to any disclaimer, the term of this patent is extended or adjusted under 35 U.S.C. 154(b) by 375 days.

(21) Appl. No.: 10/193,868

(22) Filed: Jul. 11, 2002

(51) Int. Cl.[7] ..... A47L 13/10; A47L 13/12
(52) U.S. Cl. ..... 15/106; 15/160; 15/104.92
(58) Field of Search ..... 15/106, 160, 161, 15/104.92

(56) References Cited

U.S. PATENT DOCUMENTS 970,332 A * 9/1910 Hitt ..... 15/161
1,219,051 A * 3/1917 Tallaksen ..... 15/160
4,821,358 A * 4/1989 Wyckoff et al. ..... 15/104.92
D355,734 S * 2/1995 Goble ..... D32/14.1
5,794,301 A * 8/1998 Hietala ..... 15/104.92
5,878,460 A * 3/1999 Bruce ..... 15/160
2002/0152568 A1 * 10/2002 Dillinger ..... 15/104.92
2002/0174499 A1 * 11/2002 Meshbesher ..... 15/104.92
2002/0189039 A1 * 12/2002 Schlem ..... 15/104.92

* cited by examiner

*Primary Examiner*—Randall Chin

(57) ABSTRACT

A portable golf club washer has a first golf iron brush that has a bristle side. A second golf iron brush has a bristle side. The second golf iron brush and the first golf iron brush are connected to end plates so that the second golf iron brush bristle side faces the first golf iron brush bristle side. A golf wood brush has a bristle side. The golf wood brush is connected to the second golf iron brush. The golf wood brush bristle side faces away from the second golf iron brush bristle side. A handle is connected to the first golf iron brush.

8 Claims, 2 Drawing Sheets

PORTABLE GOLF CLUB WASHER

BACKGROUND OF THE INVENTION

1. Field of the Invention

The present invention relates to a portable golf club washer for use in connection with golfing accessories. The portable golf club washer has particular utility in connection with an apparatus for cleaning the heads of golf clubs.

2. Description of the Prior Art

Portable golf club washers are desirable for cleaning the dirt and grass off of irons and woods. When golf clubs are used they get dirty their striking effectiveness decreases, their balance is thrown off and it may effect the angle of rebound of the golf balls thus throwing off a golf game.

The use of golfing accessories is known in the prior art. For example, U.S. Pat. No. 4,734,952 to Parchment et al discloses a cleaning apparatus for golf clubs that includes an open top tub for holding a cleaning solution, and brushes within the tub for removing dirt and grass from a golf club head when inserted into the tub between the brushes. The tub is provided a drain near its lower end to facilitate the removal of the cleaning solution. A gasket is placed over the open upper-end of the tub, and is provided several flaps that permit a golf club head to be passed through the gasket and into the tub interior for cleaning. The gasket tends to retain the cleaning solution within the tub interior by forming a barrier to outward passage of the cleaning solution. However, the Parchment et al '952 patent does not have triple brush construction that allows for different cleaning configurations to clean irons and woods as well as the feature of having the brushes removably positioned within a cleansing liquid whereby the brushes can be provided with agitated movement.

Similarly, U.S. Pat. No. 5,732,435 to Williams et al discloses a portable cleaning device for golf clubs that comprises a receptacle for containing cleaning solution open at its upper end for receiving a golf-club head to be cleaned. The device has at least one brush mounted within the receptacle for engagement with the club head. An extension of the base portion projects outwardly of the device a sufficient distance to receive at least a portion of a user's foot thereon to stabilize the cleaning device when supported in an upright position on a horizontal surface. A handle may be formed on the base portion extension for lifting and transporting or for storing and draining the cleaning device. A cap may be provided for closing the upper end of the receptacle to prevent loss of cleaning liquid during transportation and handling of the cleaning device. However, the Williams et al '435 patent does not have triple brush construction that allows for different cleaning configurations to clean irons and woods as well as the feature of having the brushes removably positioned within a cleansing liquid whereby the brushes can be provided with agitated movement.

Lastly, U.S. Pat. No. 4,380,839 to Caradonna discloses a golf iron washer that includes a housing that has a bottom wall, a pair of integral front and rear vertical walls, and a pair of integral side vertical walls, and which is open at the upper end thereof. The housing has cleaning member support means for supporting a pair of cleaning members disposed on the sides with their cleaning elements extended toward each other in opposing relationship. A cover member is releasably mounted on the upper open end of said housing and it has an opening formed therethrough for the passage therethrough of a golf iron. A predetermined level of cleaning fluid is disposed in said housing. The cover member is provided with inwardly extended integral guide walls which have their lower ends abutting engagement with the cleaning members for releasably retaining them in the cleaning member support means. When a golf iron is manually inserted head first through the opening in said cover member the golf iron head is guided by the guide walls between said cleaning members, and continued manual reciprocating of the golf iron results in a washing of the golf iron head. However, the Caradonna '839 patent does not have triple brush construction that allows for different cleaning configurations to clean irons and woods as well as the feature of having the brushes removably positioned within a cleansing liquid whereby the brushes can be provided with agitated movement.

While the above-described devices fulfill their respective, particular objectives and requirements, the aforementioned patents do not describe a portable golf club washer that allows an apparatus for cleaning the heads of golf clubs. The Parchment et al '952, Williams et al '435 and Caradonna '839 patents make no provision for triple brush construction that allows for different cleaning configurations to clean irons and woods as well as the feature of having the brushes removably positioned within a cleansing liquid whereby the brushes can be provided with agitated movement.

Therefore, a need exists for a new and improved portable golf club washer that can be used for an apparatus for cleaning the heads of golf clubs. In this regard, the present invention substantially fulfills this need. In this respect, the portable golf club washer according to the present invention substantially departs from the conventional concepts and designs of the prior art, and in doing so provides an apparatus primarily developed for the purpose of an apparatus for cleaning the heads of golf clubs.

SUMMARY OF THE INVENTION

In view of the foregoing disadvantages inherent in the known types of golfing accessories now present in the prior art, the present invention provides an improved portable golf club washer, and overcomes the above-mentioned disadvantages and drawbacks of the prior art. As such, the general purpose of the present invention, which will be described subsequently in greater detail, is to provide a new and improved portable golf club washer and method which has all the advantages of the prior art mentioned heretofore and many novel features that result in a portable golf club washer which is not anticipated, rendered obvious, suggested, or even implied by the prior art, either alone or in any combination thereof.

To attain this, the present invention essentially comprises a first golf iron brush that has a bristle side. A second golf iron brush has a bristle side. The second golf iron brush and the first golf iron brush are connected to end plates so that the second golf iron brush bristle side faces the first golf iron brush bristle side. A golf wood brush has a bristle side. The golf wood brush is connected to the second golf iron brush. The golf wood brush bristle side faces away from the second golf iron brush bristle side. A handle is connected to the first golf iron brush.

There has thus been outlined, rather broadly, the more important features of the invention in order that the detailed description thereof that follows may be better understood and in order that the present contribution to the art may be better appreciated.

The invention may also include and end plate. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable golf club washer that has all of the advantages of the prior art golfing accessories and none of the disadvantages.

It is another object of the present invention to provide a new and improved portable golf club washer that may be easily and efficiently manufactured and marketed.

An even further object of the present invention is to provide a new and improved portable golf club washer that has a low cost of manufacture with regard to both materials and labor, and which accordingly is then susceptible of low prices of sale to the consuming public, thereby making such portable golf club washer economically available to the buying public.

Still another object of the present invention is to provide a new portable golf club washer that provides in the apparatuses and methods of the prior art some of the advantages thereof, while simultaneously overcoming some of the disadvantages normally associated therewith.

Lastly, it is an object of the present invention is to provide a portable golf club washer for an apparatus for cleaning the heads of golf clubs.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
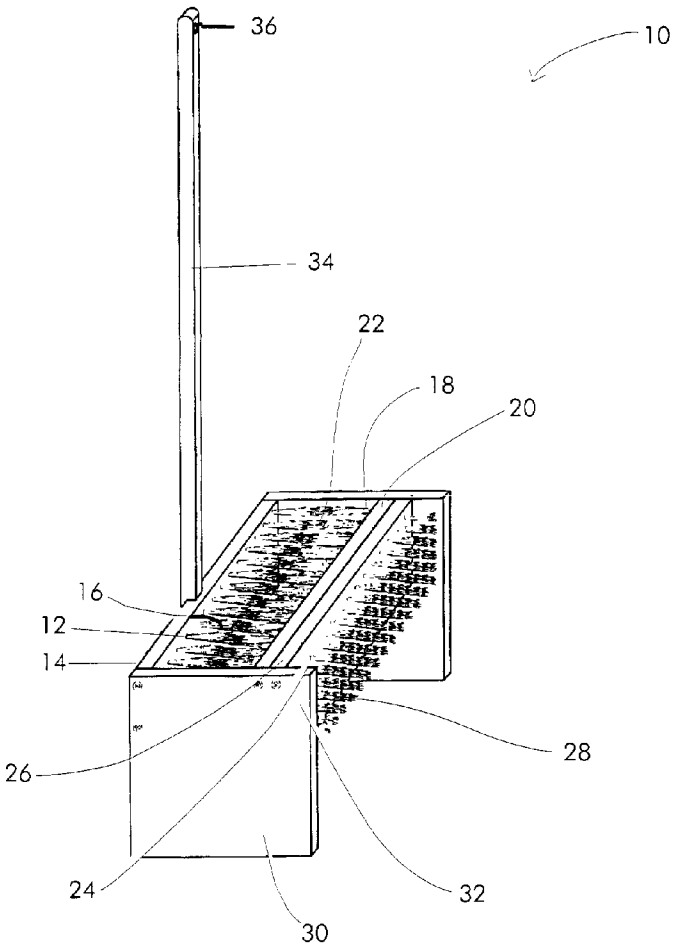
FIG. 1 is a top perspective view of the preferred embodiment of the portable golf club washer constructed in accordance with the principles of the present invention.
Figure 2:
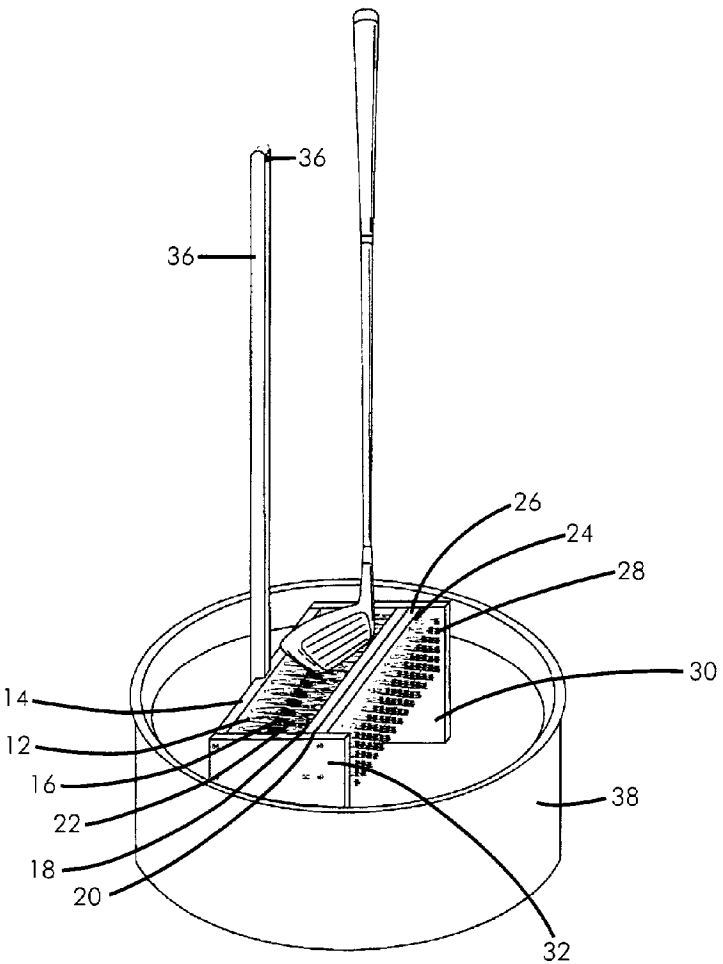
FIG. 2 is a top perspective view of the portable golf club washer of the present invention.

Referring now to the drawings, and particularly to FIGS. 1–2, a preferred embodiment of the portable golf club washer of the present invention is shown and generally designated by the reference numeral 10.

In FIG. 1, a new and improved portable golf club washer 10 of the present invention for an apparatus for cleaning the heads of golf clubs is illustrated and will be described. More particularly, the portable golf club washer 10 has a first golf iron brush 12 that has two sides, a backing side 14 and a bristle side 16. A second golf iron brush 18 has two sides, a backing side 20 and a bristle side 22 and faces the first golf iron brush bristle side 16. The first golf iron brush bristles and the second golf iron bristles are spaced 3/16 to 1/4 inch apart. A golf wood brush 24 has two sides, a backing side 26 and a bristle side 28, is connected to the second golf iron brush 18. The golf wood brush bristle side 28 faces away from the second golf iron brush bristle side 22. The first golf iron brush, the second golf iron brush and the golf wood brush measure approximately 6½ to 7 inches long, having bristles approximately one inch long in the present example. An end plate 30 has a top end 32. The end plates measure 5 inches long by 5½ inches wide by 1/4 inches thick in the present example. The first golf iron brush backing side 14 is connected to the end plate adjacent said top end 32. The second golf iron brush backing side 20 is connected to the end plate adjacent said top end 32. The golf wood brush backing side 26 is connected to the end plate adjacent said top end 32. A handle 34 is connected to the first golf iron brush backing side 14. The handle is 21 inches long. The handle 34 has a support hole 36 therein, the support hole being 3/8 inches diameter in the present example.

In FIG. 2, the portable golf club washer 10 is illustrated and will be described. The portable golf club washer 10 has the first golf iron brush 12 that has two sides, the backing side 14 and the bristle side 16. The second golf iron brush 18 has two sides, the backing side 20 and the bristle side 22. The second golf iron brush 18 and the first golf iron brush 12 are both connected to end plates 30, so that the second golf iron brush bristle side 22 faces the first golf iron brush bristle side 16. The golf wood brush 24 has two sides, the backing side 26 and the bristle side 28. The golf wood brush 24 is connected to the second golf iron brush 18. The golf wood brush bristle side 28 faces away from the second golf iron brush bristle side 22. The end plate 30 has the top end 32. The first golf iron brush backing side 14 is connected to the end plate adjacent said top end 32. The second golf iron brush backing side 20 is connected to the end plate adjacent said top end 32. The golf wood brush backing side 26 is connected to the end plate adjacent said top end 32. The handle 34 is connected to the first golf iron brush backing side 14. The handle 34 has the support hole 36 therein. A tub 38 is capable of containing washing fluid to clean the golf clubs.

In use, it can now be understood that the user places the portable golf club washer 10 in a tub 38 of water with enough water to cover the bristles. The user then holds the handle with one hand while taking the golf club in the other hand. The head of a golf club is inserted between the brushes that face each other and is moved up and down to remove dirt and grass. The brush that faces outward is used to clean woods such as a driver and three or five woods. When finished the water is dumped, and the portable golf club washer 10 is hung up by the handle support hole 36.

While a preferred embodiment of the portable golf club washer has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or plastic may be used instead of the wood described. Also, the metal arm may also be made of heavy-duty plastic, wood, or similar material. And although an apparatus for cleaning the heads of golf clubs have been described, it should be appreciated that the portable golf club washer herein described is also suitable for cleaning shoes.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable golf club washer comprising:

a first golf iron brush having two sides a backing side and a bristle side;

a second golf iron brush having two sides a backing side and a bristle side, said second golf iron brush bristle side facing said first golf iron brush bristle side;

a golf wood brush having two sides a backing side and a bristle side, said golf wood brush connected to said second golf iron brush, said golf wood brush bristle side facing away from said second golf iron brush bristle side; and a handle connected to said first golf iron brush;

an end plate connected to said first golf iron brush, to said second golf iron brush, and to said golf wood brush.

2. The portable golf club washer of claim 1 wherein:

side end plate has a top end, said first golf iron brush backing side connected to said end plate adjacent said top end, said second golf iron brush backing side connected to said end plate adjacent said top end, said golf wood brush backing side connected to said end plate adjacent said top end.

3. The portable golf club washer of claim 1 wherein:

said handle has a support hole therein.

4. The portable golf club washer of claim 1 wherein:

said handle is connected to said first golf iron brush backing side.

5. The portable golf club washer of claim 1 further comprising:

a tub which is capable of containing washing fluid to clean said golf clubs.

6. The portable golf club washer of claim 1 wherein:

said end plate has a top end, said first golf iron brush backing side connected to said end plate adjacent said top end, said second golf iron brush backing side connected to said end plate adjacent said top end.

7. A portable golf club washer comprising:

a first golf iron brush having two sides a backing side and a bristle side;

a second golf iron brush having two sides a backing side and a bristle side, said second golf iron brush bristle side facing said first golf iron brush bristle side;

a golf wood brush having two sides a backing side and a bristle side, said golf wood brush connected to said second golf iron brush, said golf wood brush bristle side facing away from said second golf iron brush bristle side;

an end plate having a top end, said first golf iron brush backing side connected to said end plate adjacent said top end, said second golf iron brush backing side connected to said end plate adjacent said top end, said golf wood brush backing side connected to said end plate adjacent said top end; and a handle connected to said first golf iron brush backing side, said handle having a support hole therein.

8. The portable golf club washer of claim 7 further comprising:

a tub which is capable of containing washing fluid to clean said golf clubs.

* * * * *